United States Patent [19]

Kitajima

[11] 4,435,070

[45] Mar. 6, 1984

[54] VARIABLE MAGNIFICATION COPYING APPARATUS

[75] Inventor: Tadayuki Kitajima, Yokohama, Japan

[73] Assignee: Canon Kabushiki Kaisha, Tokyo, Japan

[21] Appl. No.: 428,271

[22] Filed: Sep. 29, 1982

Related U.S. Application Data

[63] Continuation of Ser. No. 318,986, Nov. 6, 1981, abandoned.

[30] Foreign Application Priority Data

Nov. 10, 1980 [JP] Japan ..... 55-157953

[51] Int. Cl.[3] ..... G03G 15/00

[52] U.S. Cl. ..... 355/8; 355/55; 355/56; 355/66; 355/14 E

[58] Field of Search ..... 355/8, 14 R, 3 R, 10, 355/13, 55, 56, 58, 66

[56] References Cited

U.S. PATENT DOCUMENTS

| | | | |
|---|---|---|---|
| 3,357,325 | 12/1967 | Eichorn et al. | 355/3 R |
| 3,653,756 | 4/1972 | Mielnikonski et al. | 355/3 R |
| 3,884,574 | 5/1975 | Doi et al. | 355/66 |
| 3,900,256 | 8/1975 | Ravera et al. | 355/8 X |
| 4,175,850 | 11/1979 | Bujese | 355/14 R X |
| 4,190,349 | 2/1980 | Ohno et al. | 355/8 |
| 4,295,731 | 10/1981 | Sasaki et al. | 355/14 R X |

*Primary Examiner*—A. C. Prescott

*Attorney, Agent, or Firm*—Fitzpatrick, Cella, Harper & Scinto

[57] ABSTRACT

A variable magnification copying apparatus which includes a first shaft having thereon a plurality of gears different in diameter, a second shaft having thereon a plurality of gears different in diameter, the gears of smaller diameters on the second shaft corresponding to the gears of larger diameters on the first shaft, a cam shaft having thereon a plurality of cams corresponding to the pairs of gears on the first and second shafts, a lever biased so as to bear against each of the cams, and a relay gear rotatably supported on each of the levers, and in which the movement of the levers is controlled by intermittent rotation of the cam shaft, the gears on the first shaft are operatively associated with the gears on the second shaft through the relay gears on the controlled levers, and the number of relative rotations of the first and second shafts is varied by the gear ratio of the operatively associated gears, whereby the ratio of the original scanning velocity to the velocity of a photosensitive medium is changed correspondingly to a selected magnification.

23 Claims, 6 Drawing Figures

VARIABLE MAGNIFICATION COPYING APPARATUS

This is a continuation of application Ser. No. 318,986 filed Nov. 6, 1981 now abandoned.

BACKGROUND OF THE INVENTION

1. Field of the Invention

This invention relates to a copying apparatus of the type in which an original to be copied is scanned and a photosensitive medium is slit-exposed to the image of the original, and more particularly to a variable magnification copying apparatus whose copying magnification can be changed.

2. Description of the Prior Art

To change the copying magnification in a scanning type variable magnification copying apparatus, the image formation magnification of the optical image of an original projected upon a photosensitive medium must be changed and also the velocity ratio of the original scanning velocity to the velocity of the photosensitive medium must be changed correspondingly to a selected copying magnification. Described more particularly, assuming that the original scanning velocity is $V_1$ and the velocity of the photosensitive medium is $V_2$, the velocity ratio $V_2/V_1$ is changed in accordance with the following equation:

$$V_2/V_1=m$$

where m is a selected magnification. By changing the aforementioned velocity ratio in accordance with the above equation, the magnification of the copy image with respect to the direction of movement of the photosensitive medium, namely, the copying magnification with respect to the original scanning direction, can be rendered into a selected magnification. The magnification of the copy image with respect to a direction perpendicular to said direction is changed by changing the projection magnification of the optical image, as mentioned above.

Generally, in most apparatus, the aforementioned velocity ratio is changed by changing the original scanning velocity. For example, U.S. Pat. No. 3,884,574 discloses an original scanning velocity changing device which comprises a combination of a plurality of gear sprockets, a chain and a plurality of electromagnetic clutches. In such a device, however, at least the same number of electromagnetic clutches as the number of copying magnifications which can be selected is required. This not only makes the construction of the device complicated, but also the length of time from the point of time at which the main switch is closed till the point of time at which operation is started is irregular between individual clutches and such irregularity results in the irregularity of the point of time at which image formation is started.

U.S. application Ser. No. 141,922 describes a copying apparatus in which the velocity of the photosensitive medium is changed to change the copying magnification. Again in this apparatus, the velocity of the photosensitive medium is changed correspondingly to a selected magnification by a plurality of gears and a plurality of electromagnetic clutches, and this leads to an inconvenience similar to that described just above.

SUMMARY OF THE INVENTION

It is an object of the present invention to provide a variable magnification copying apparatus which can overcome the above-noted disadvantages perculiar to the apparatus of the prior art.

It is another object of the present invention to provide a variable magnification copying apparatus provided with velocity ratio changing means which is simple in construction and which can easily be made compact.

It is still another object of the present invention to provide a variable magnification copying apparatus provided with velocity ratio changing means which is accurate in operation.

Other objects and features of the present invention will become apparent from the following detailed description taken in conjunction with the accompanying drawings.

DESCRIPTION OF THE PREFERRED EMBODIMENTS

Figure 1:
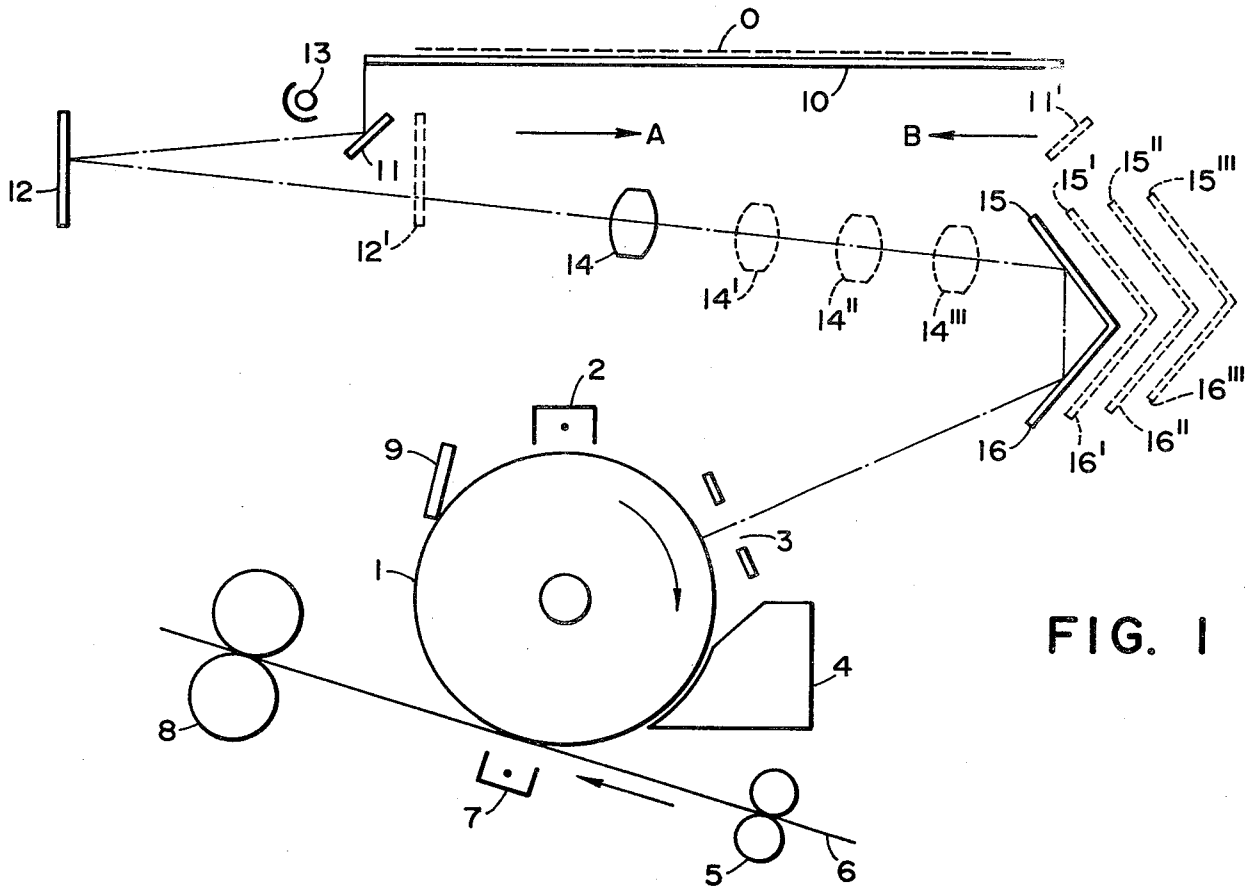
FIG. 1 illustrates an example of a copying apparatus to which the present invention is applicable.

Referring to FIG. 1, a photosensitive drum 1 having an electrophotographic photosensitive layer on the peripheral surface thereof is rotated in the direction of arrow. With its rotation, the drum 1 is first charged by a corona discharger 2, and then is exposed the optical image of an original O through a slit opening 3, whereby an electrostatic latent image corresponding to the original is formed on the drum 1. This latent image is developed by a developing device 4, whereby a toner image corresponding to the original is formed on the drum 1. This toner image is transferred to copy paper 6 by the action of an image transfer corona discharger 7, the copy paper 6 being conveyed by a pair of conveyor rollers 5 driven in synchronism with the original scanning to be described. After the image transfer, the toner image is fixed on the paper 6 by a pair of fixing rollers 8 while, on the other hand, any toner remaining on the drum 1 is removed from the drum 1 by a cleaning device 9. Thus, the drum 1 becomes ready to be again used for the image formation process.

The original O to be copied rests on a stationary original supporting table 10. The original O is scanned by movable mirrors 11 and 12. That is, the mirror 11 is moved in the direction of arrow A parallel to the original supporting table 10. The mirror 12 is moved in the same direction as the mirror 11 at ½ of the movement velocity of the mirror 11. The original is scanned by the movement of the mirrors 11 and 12 in the direction of arrow A. When the mirrors 11 and 12 come to their respective broken-line positions 11' and 12 at the end of the original scanning, they are moved backwardly in the direction of arrow B at a velocity ratio of 1:½ and return to their forward movement starting positions indicated by solid lines. A lamp 13 is fixed to the support member of the mirror 11 and is moved with the mirror 11. The lamp 13 is turned on to illuminate the original at least during the original scanning, namely, when the mirrors 11 and 12 are being moved in the direction of arrow. By the mirrors 11 and 12 being moved parallel to the original supporting table 10 at the velocity ratio of $1:\frac{1}{2}$, the length of the optical path between the original O and a lens is maintained constant during the original scanning.

The light from the original O is reflected by the mirrors 11 and 12 in succession and directed to a lens 14. The original image forming light beam passed through the lens 14 is then reflected by mirrors 15 and 16 in succession and impinges on the drum 1 through the slit 3. That is, the drum 1 is slit-exposed to the optical image of the original.

During the formation of one-to-one magnification image, the lens 14 is at its position indicated by solid line and the mirrors 15 and 16 are at their positions indicated by solid lines. During magnification changing operation, the lens 14 and mirrors 15 and 16 are moved to their respective positions corresponding to the selected magnification. Thus, during $m_1$ magnification copying, the lens 14 and mirrors 15 and 16 lie at their broken-line positions 14', 15' and 16', during $m_2$ magnification copying, they lie at their broken-line positions 14'', 15'' and 16'', and during $m_3$ magnification copying, they lie at their broken-line positions 14''', 15''' and 16'''. In this manner, the length of the optical path between the original and the lens and the length of the optical path between the lens and the drum are changed correspondingly to the selected magnification so that an optical image at the selected magnification is formed on the drum 1. It is to be understood that $1>m_1>m_2>m_3>0$.

In order to render the magnification of the copy image with respect to the direction of rotation of the drum 1 into the selected magnification, the ratio of the original O scanning speed or the movement velocity of the mirror 11 in the direction of arrow A to the peripheral velocity of the drum 1 is changed as described previously correspondingly to the selected magnification. Most apparatus are of the type in which change in the copying magnification results in change in the original scanning speed and therefore, description will first be made of an example in which the present invention is applied to such apparatus.

In FIG. 1, when the copying magnification is changed, the movement velocity of the mirror 11 in the direction of arrow A is changed. Assuming that the peripheral velocity of the drum 1 is $V_2$ and the selected magnification is m, the movement velocity of the mirror 11 in the direction of arrow A can be expressed as $V_1=V_2/m$. The movement velocity of the mirror 12 in the direction of arrow A is $V_2/2m$.

Figure 2:
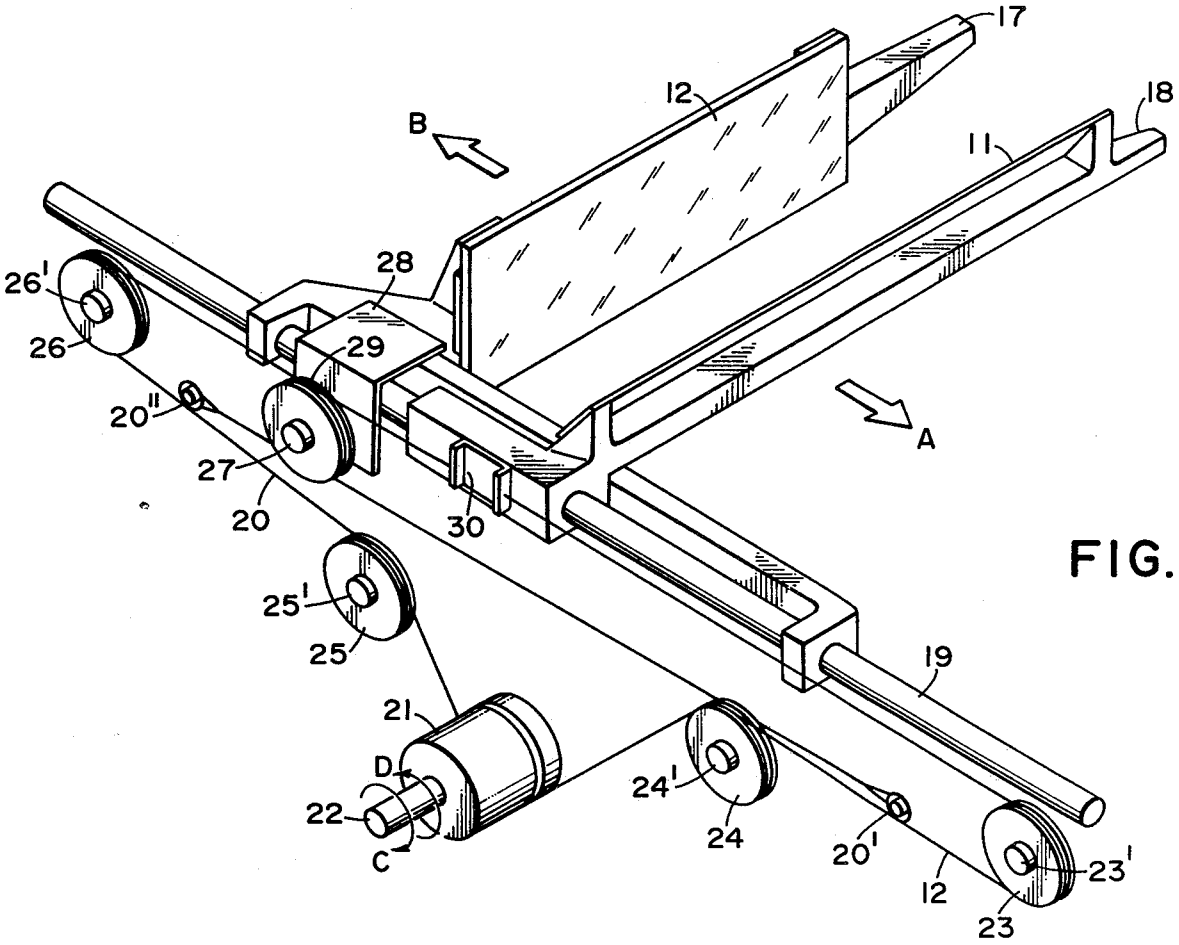
FIG. 2 illustrates an example of a device for moving the mirrors 11 and 12 of FIG. 1.

Referring now to FIG. 2, the first movable mirror 11 is fixed to a first movable mirror supporting bed 17, one end of which is slidably fitted to a straight guide shaft 19. Thus, the mirror 11 is movable along the guide shaft 19 with the bed 17. The second movable mirror 12 is fixed to a second movable mirror supporting bed 18, one end of which is also slidably fitted to the guide shaft 19. Thus, the mirror 12 is movable along the guide shaft 19 with the bed 18.

Designated by 20 is a wire passed over a scanning system drive output pulley 21. This pulley 21 is connected to an output shaft 22, to be described by an electromagnetic clutch. Denoted by 23', 24', 25' and 26' are shafts provided at fixed positions within the copying apparatus. Pulleys 23, 24, 25 and 26 are rotatably supported on the shafts 23', 24', 25' and 26', respectively. Designated by 27 is a shaft fixed to a support plate 28 which in turn is fixed to the first mirror supporting bed 17. A pulley 29 is rotatably supported on the shaft 27. One end 20' of the wire 20 is secured to a fixed position within the copying apparatus. The wire 20 is passed over the pulley 29, and then fixed to the second mirror bed 18 by a fixed member 30, and then passed over the pulley 23 and over the pulley 24, and then wound around the pulley 21 one or more turns. The wire 20 is then passed over the pulley 25 and over the pulley 26, and then over the pulley 29. The other end 20'' of the wire 20 is secured to a fixed position within the copying apparatus.

Thus, if the output pulley 22 is rotatively driven in the direction of arrow C, the mirrors 11 and 12 are pulled by the wire 20 and moved in the direction of arrow A at a velocity ratio of $1:\frac{1}{2}$ to scan the original O. Also, if the original scanning is terminated and the output pulley 22 is rotatively driven in the direction of arrow D, the mirrors 11 and 12 are pulled in the opposite direction by the wire 20 and moved in the direction of arrow B at a velocity ratio of $1:\frac{1}{2}$.

Figure 3:
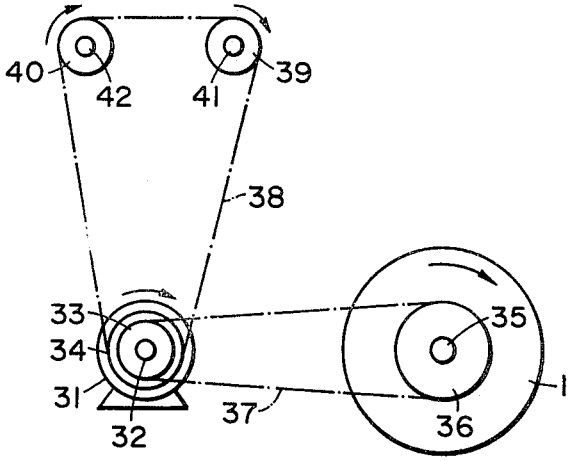
FIG. 3 illustrates a mechanism for transmitting the drive force to the drum 1 and mirrors 11, 12 of FIG. 1.

Referring to FIG. 3, sprockets 33 and 34 are fixed to the output shaft 32 of a driving motor 31 which revolves at the same speed during copying at any magnification. The motor 31 revolves from after at least a copy switch has been closed until the required image formation process is terminated, and forward and backward movement of the mirrors 11 and 12 takes place during the revolution of the motor 31. The motor 31 rotates the sprockets 33 and 34 in the direction of arrow. The rotation of the sprocket 33 is transmitted to a sprocket 36 by a chain 37. Since the sprocket 36 is fixed to the fixed shaft 35 of the drum 1, the drum 1 is rotatively driven in the direction of arrow by the motor 31. A chain 38 is passed over the sprocket 34 and also passed over sprockets 39 and 40. The sprocket 39 is fixed to a first input shaft 41 and the sprocket 40 is fixed to a second input shaft 42. Accordingly, the shafts 41 and 42 are rotatively driven in the direction of arrow by the revolution of the motor 31.

Figure 4:
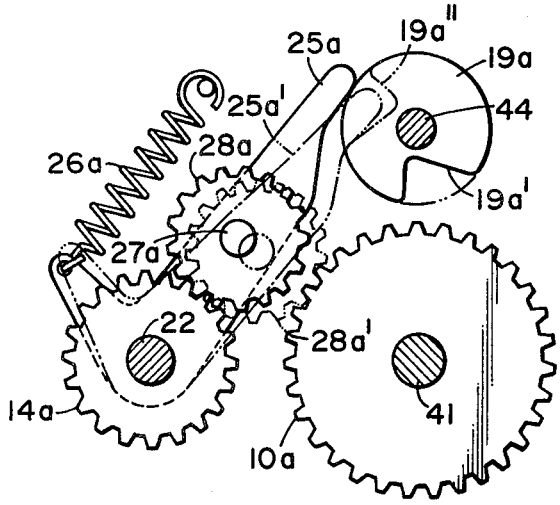
FIG. 4 is a side view of essential portions of a velocity changing device employed in the apparatus of FIG. 1.
Figure 6:
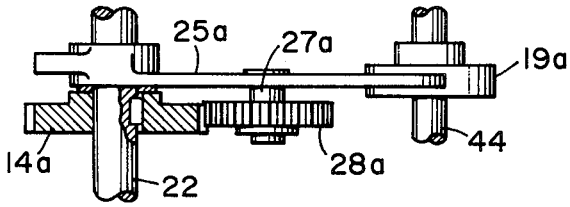
FIG. 6 is a plan view of another portion of the FIG. 4 device.
Figure 5:
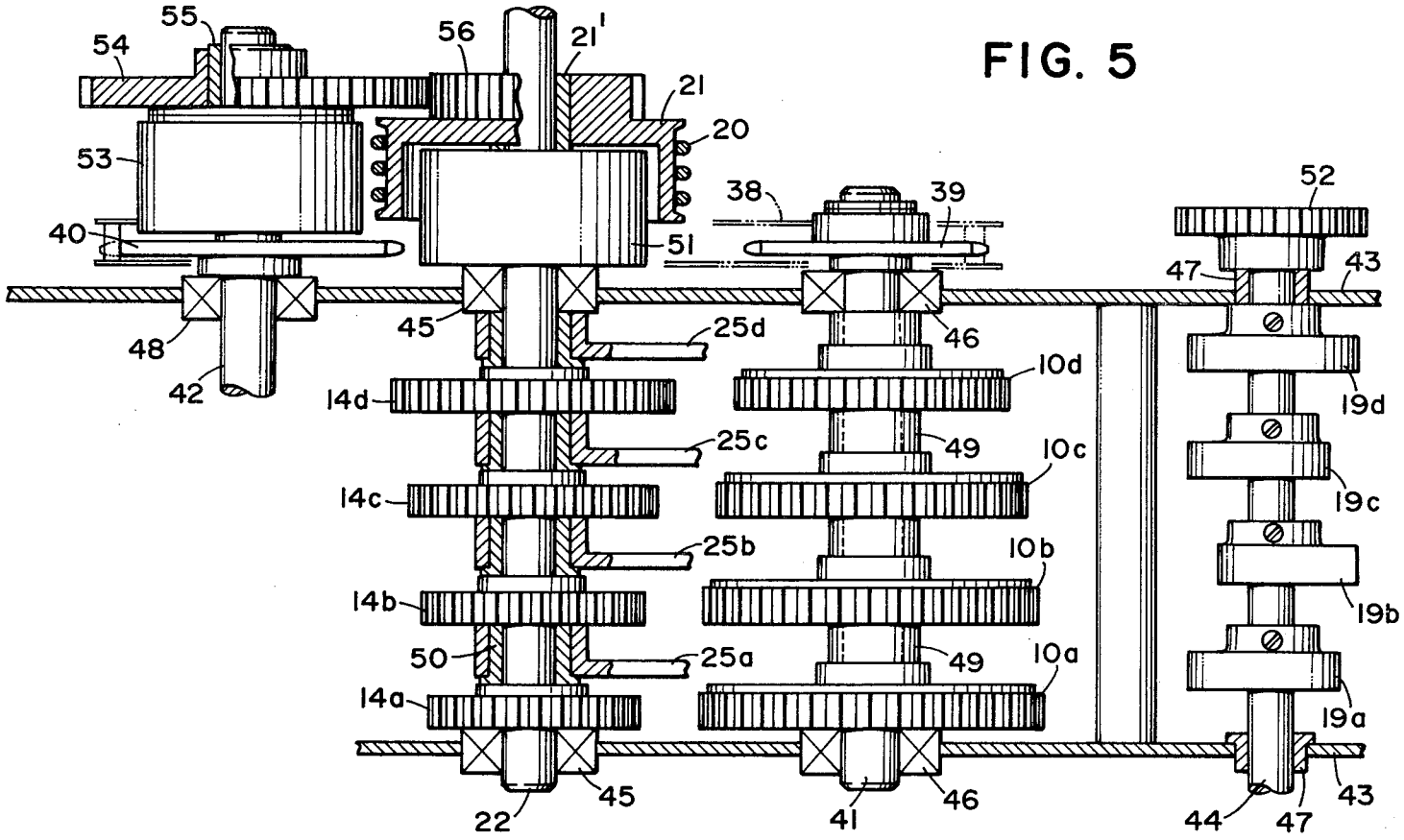
FIG. 5 is a plan view of a portion of the FIG. 4 device.

Reference is now had to FIGS. 4, 5 and 6 to fully describe a device for changing the velocities of the mirrors 11 and 12.

Shafts 22, 41, 42 and 44 are rotatably mounted on a machine frame 43 through bearings 45, 46, 47 and 48. Four gears **10*a*–10*d* different in diameter are mounted on the shaft 41 as a first input shaft with spacers 49 interposed between the gears. Rotational force is imparted from a drive source 31 to the sprocket 39, mounted on one end of the shaft 41, through a roller chain 38**.

Four gears **14*a*–14*d* different in diameter are mounted on the shaft 22 as an output shaft with spacers 50 interposed between the gears in such a relationship that the gears of smaller diameters are opposed to the gears of larger diameters on the shaft 41. An electromagnetic clutch 51 is integrally secured to one end portion of the shaft 22, and the output pulley 21 is rotatably mounted on the shaft 22 through a bearing 21' in opposed relationship with the electromagnetic clutch 51**.

Four cams **19*a*–19*d* each having a recess in a portion of its circumference are mounted on the shaft 44 at predetermined intervals. Rotational force may be imparted from an unshown drive source such as a pulse motor to a gear 52 provided on one end of the cam shaft 44**.

A sprocket 40 meshing with the roller chain 38 and an electromagnetic clutch 53 are integrally secured to the second input shaft 42, and a bear 54 is rotatably mounted on the shaft 42 through a bearing 55 in opposed relationship with the electromagnetic clutch 53. This gear 54 is in mesh engagement with a gear 56 integrally fixed to the pulley 21.

Levers 25*a*–25*d* are rotatably mounted to the spacers 50 on the shaft 22 and normally biased clockwisely (as viewed in FIG. 4) by springs 26*a*–26*d*, respectively (only spring 26*a* is shown in FIG. 4). By the resilient force of respective one of the springs, the free end of the lever 25*a* is caused to bear against the cam 19*a*, the free end of the lever 25*b* is caused to bear against the cam 19*b*, the free end of the lever 25*c* is caused to bear against the cam 19*c*, and the free end of the lever 25*d* is caused to bear against the cam 19*d*.

Shafts 27*a*–27*d* are studded in the levers 25*a*–27*d*, respectively. (Only the shaft 27*a* is shown in FIGS. 4 and 6.) An idler gear 28*a* is rotatably supported on the shaft 27*a* of the lever 25*a*, an idler gear 28*b* on the shaft 27*b* of the lever 25*b*, an idler gear 28*c* on the shaft 27*c* of the lever 25*c*, and an idler gear 28*d* on the shaft 27*d* of the lever 25*d*. (Only the idler gear 28*a* is shown in FIGS. 4 and 6).

The idler gears 28*a*, 28*b*, 28*c* and 28*d* are normally in mesh engagement with the gears 14*a*, 14*b*, 14*c* and 14*d*, respectively. During $m_3$ magnification copying, for example, the recess 19*a*′ of the cam 19*a* fixed to the shaft 44 is held at a dots-and-dash line position 19*a*″ indicated in FIG. 4. Thus, as shown by a dots-and-dash line 25*a*′ in FIG. 4, the lever 25*a* is engaged with the recess 19*a*′ of this cam 19*a*, whereby the gear 28*a* is in mesh engagement with both of the gears 14*a* and 10*a* indicated by dots-and-dash line 28*a*′ in FIG. 4. On the other hand, the other levers 25*b*, 25*c* and 25*d* bear against the circumferential portions of the corresponding cams 19*b*, 19*c* and 19*d*. Accordingly, the other idler gears 28*b*, 28*c* and 28*d* are spaced apart from the corresponding gears 10*b*, 10*c* and 10*d*. Thus, during $m_3$ magnification copying, the rotational force of the shaft 41 is transmitted to the shaft 22 through the gears 10*a*, 28*a* and 14*a*.

Next, when the copying mode is changed, for example, from $m_3$ magnification copying mode to $m_2$ magnification copying mode, the shaft 44 is caused to make $\frac{1}{4}$ of one full rotation through the gear 52. Thereby, the cam 19*a* makes $\frac{1}{4}$ of one full rotation and the free end of the lever 25*a* rides onto the circumferential surface of the cam 19*a* and therfore, the lever 25*a* pivots counterclockwisely about the shaft 22. Accordingly, the idler gear 28*a* reotates about the shaft 22 while being in mesh engagement with the gear 14*a* and becomes separate from the gear 10*a*. On the other hand, the cam 19*b* also makes $\frac{1}{4}$ of one full rotation, whereby the free end of the lever 25*b* drops into the recess of the cam 19*b*. Accordingly, the idler gear 28*b* rotates about the shaft 22 while being in mesh engagement with the gear 14*b* and comes into mesh engagement with the gear 10*b*. The free ends of the levers 25*c* and 25*d* are in engagement with the circumferential surfaces of the cams 19*c* and 19*d*, respectively. Consequently, the idler gears 28*c* and 28*d* remain spaced apart from the gears 10*c* and 10*d*, respectively. Consequently, during $m_2$ magnification copying, the rotational force of the shaft 41 is transmitted to the shaft 22 through the gears 10*b*, 28*b* and 14*b*.

During $m_1$ magnification copying, in the same manner as described above, the idler gear 28*c* meshes with the gears 14*c* and 10*c* and the rotational force of the shaft 41 is transmitted to the shaft 22 through the gears 10*c*, 28*c* and 14*c*, and during one-to-one magnification copying, the idler gear 28*d* meshes with the gears 14*d* and 10*d* and the rotational force of the shaft 41 is transmitted to the shaft 22 through the gears 10*d*, 28*d* and 14*d*.

The cams 19*a*, 19*b*, 19*c* and 19*d* are fixed to the shaft 44 in such a manner that their respective recesses are deviated by 90° with respect to the shaft 44. That is, the cams 19*a*, 19*b*, 19*c* and 19*d* are fixed to the shaft 44 with different mounting phase angles. When the copying magnification is changed, the shaft 44 rotates by an angle corresponding to the selected magnification. Accordingly, during copying operation, of the aforementioned four idler gears, only one which corresponds to the selected magnification can contribute to the transmission of rotational force from the input shaft 41 to the output shaft 22. The gear ratios of the pairs of gears 10*a* and 14*a*, the pair of gears 10*b* and 14*b*, the pair of gears 10*c* and 14*c*, and the pair of gears 10*d* and 14*d* are selected corresponding to $m_3$ magnification copying, $m_2$ magnification copying, $m_1$ magnification copying and one-to-one magnification copying, respectively. For example, the rotational speed of the shaft 22 when rotated through the agency of the gears 10*a*, 28*a* and 14*a* is $m_1/m_3$ times the rotational speed of the shaft 22 when rotated through the agency of the gears 10*c*, 28*c* and 14*c*.

When copying operation is started and an original scanning start signal is applied to an electromagnetic clutch 51 for forward movement, the electromagnetic clutch 51 attracts the pulley 21 to couple his pulley to the shaft 22 and rotatively drive the pulley 21 in the direction of arrow C and take up the wire 20 wound on the pulley 21, thereby moving the mirrors 11 and 12 forwardly. As is apparent from the foregoing, the forward movement velocities of the mirrors 11 and 12 correspond to the selected copying magnification. When the original scanning is terminated and a reversing signal is put out, the input to the electromagnetic clutch 51 is cut off and an electromagnetic clutch 53 for backward movement is actuated. Therefore, the electromagnetic clutch 53 attracts a gear 54 to couple this gear to the shaft 42, so that rotational force in the opposite direction is transmitted through this gear 54 to a gear 56 integral with the pulley 21, whereby the pulley 21 is rotated in the direction of arrow D to move the mirrors 11 and 12 backwardly.

In the above-described example, the levers 25*a*–25*d* are provided on the shaft 22, but alternatively, they may be pivotally supported on the shaft 41. In this latter case, the idler gears 28*a*–28*d* are normally in mesh engagement with corresponding ones of the gears 10*a*–10*d*, and only the idler gear corresponding to the selected magnification is displaced into mesh engagement with one of the gears 14*a*–14*d* which corresponds to the selected magnification.

The present invention is also applicable to a copying apparatus in which the velocity of the photosensitive medium is changed correspondingly to a selected magnification. In that case, the drum 1 is mounted on the shaft 22 shown in FIGS. 4, 5 and 6. A sprocket is fixed to the shaft 22 of FIG. 2 so that the rotative drive force from the motor is transmitted to the sprocket, and the various elements 21, 21′, 51 and 56 of FIG. 5 are mounted on the shaft 22 of FIG. 2 and a mechanism comprising elements 40, 42, 53, 54 and 55 of FIG. 5 is combined with said various elements.

The present invention is also applicable to a copying apparatus in which an original carriage supporting an original thereon is moved relative to a fixed projecting optical system to thereby scan the original or a copying apparatus having a so-called original feeding device in which an original is moved relative to a fixed projecting optical system by rollers, belt or the like to thereby scan the original.

What I claim is:

1. A variable magnification copying apparatus capable of copying originals at least first and second different copying magnifications, including:

original scanning means for scanning an original to be copied;

a photosensitive medium on which is formed the optical image of the original scanned by said original scanning means;

means for changing the magnification of the optical image of the original formed on said photosensitive medium correspondingly to a selected copying magnification;

velocity ratio changing means for changing the ratio of the original scanning velocity of said scanning means to the movement velocity of said photosensitive medium correspondingly to the selected copying magnification, said velocity ratio changing means including:

a first shaft connected to a drive source;

a second shaft connected to one of said original scanning means and said photosensitive medium;

first and second gear means provided on said first shaft;

third and fourth gear means provided on said second shaft;

displaceable fifth gear means adapted, correspondingly to said first copying magnification, to mesh with both said first gear means and said third gear means to transmit the rotational force of said first shaft to said second shaft, and adapted, correspondingly to said second copying magnification, to be disengaged from at least one of said first gear means and said third gear means; and displaceable sixth gear means adapted, correspondingly to said second copying magnification, to mesh with both said second gear means and said fourth gear means to transmit the rotational force of said first shaft to said second shaft, and adapted, during the copying at said first copying magnification, to be disengaged from at least one of said second gear means and said fourth gear means.

2. A variable magnification copying apparatus according to claim 1, further including:

first movable lever means rotatably supporting said fifth gear means;

second movable lever means rotatably supporting said sixth gear means;

first lever position changing means for displacing said first movable lever means between an operative position for causing said fifth gear means to mesh with both said first and third gear means and a non-operative position for causing said fifth gear means to be disengaged from at least one of said first and third gear means; and second lever position changing means for displacing said second movable lever means between an operative position for causing said sixth gear means to mesh with both said second and fourth gear means and a non-operative position for causing said sixth gear means to be disengaged from at least one of said second and fourth gear means.

3. A variable magnification copying apparatus according to claim 2, wherein said fifth gear means is also in mesh engagement with said third gear means when said first movable lever means is in said non-operative position, and said sixth gear means is also in mesh engagement with said fourth gear means when said second movable lever means is in said non-operative position.

4. A variable magnification copying apparatus according to claim 2, wherein said fifth gear means is also in mesh engagement with said first gear means when said first movable lever means is in said non-operative position, and said sixth gear means is also in mesh engagement with said second gear means when said second movable lever means is in said non-operative position.

5. An apparatus according to claim 2, 3 or 4, wherein said first lever position changing means has first cam means with which said first lever means engages, said second lever position changing means has second cam means with which said second lever means engages, and said first and second cam means are mounted on a third shaft, said apparatus further including means for rotatively driving said third shaft by an angle corresponding to a selected magnification.

6. An apparatus according to claim 1, 2, 3 or 4, wherein said second shaft is connected to said original scanning means.

7. An apparatus according to claim 5, wherein said second shaft is connected to said original scanning means.

8. An apparatus according to claim 1, 2, 3 or 4, wherein said second shaft is connected to said photosensitive medium.

9. An apparatus according to claim 5, wherein said second shaft is connected to said photosensitive medium.

10. A variable magnification copying apparatus capable of copying originals at least first and second different copying manifications, including:

original scanning means for scanning an original to be copied, said original scanning means being reciprocally movable along a predetermined path, and scanning the original during its forward movement and moving backwardly when the original scanning is terminated;

a photosensitive medium on which is formed the optical image of the original scanned by said original scanning means;

means for changing the magnification of the optical image of the original formed on said photosensitive medium correspondingly to a selected copying magnification;

mode changing means for changing the movement mode of said scanning means, said mode changing means including:

a rotatively driven first shaft;

a second shaft;

a rotatively driven third shaft;

an output rotatable member connected to said scanning means and putting out a drive force transmitted to said scanning means;

first clutch means adapted to connect said output rotatable member and said output second shaft to thereby move said scanning means forwardly to scan the original and adapted, upon termination of the original scanning, to release the connection between said output rotatable member and said second shaft;

second clutch means adapted, upon termination of the original scanning, to connect said output rotatable member and said third shaft to thereby rotate said rotatable member in the direction opposite to the direction of rotation by said second shaft and move said scanning means backwardly;

first and second gear means provided on said first shaft;

third and fourth gear means provided on said second shaft;

displaceable fifth gear means adapted, correspondingly to said first copying magnification, to mesh with both said first gear means and said third gear means to transmit the rotational force of said first shaft to said second shaft, and adapted, correspondingly to said second copying magnification, to be disengaged from at least one of said first gear means and said third gear means; and displaceable sixth gear means adapted, correspondingly to said second copying magnification, to mesh with both said second gear means and said fourth gear means to transmit the rotational force of said first shaft to said second shaft, and adapted, correspondingly to said first copying magnification, to be disengaged from at least one of said second gear means and said fourth gear means.

11. A variable magnification copying apparatus according to claim 10, further including:

first movable lever means rotatably supporting said fifth gear means;

second movable lever means rotatably supporting said sixth gear means;

first lever position changing means for displacing said first movable lever means between an operative position for causing said fifth gear means to mesh with both said first and third gear means and a non-operative position for causing said fifth gear means to be disengaged from at least one of said first and third gear means; and second lever position changing means for displacing said second movable lever means between an operative position for causing said sixth gear means to mesh with both said second and fourth gear means and a non-operative position for causing said sixth gear means to be disengaged from at least one of said second and fourth gear means.

12. A variable magnification copying apparatus according to claim 11, wherein said fifth gear means is also in mesh engagement with said third gear means when said first movable lever means is in said non-operative position, and said sixth gear means is also in mesh engagement with said fourth gear means when said second movable lever means is in said non-operative position.

13. A variable magnification copying apparatus according to claim 11, wherein said fifth gear means is also in mesh engagement with said first gear means when said first movable lever means is in said non-operative position, and said sixth gear means is also in mesh engagement with said second gear means when said second movable lever means is in said non-operative position.

14. An apparatus according to claim 11, 12 or 13, wherein said first lever position changing means has first cam means with which said first lever means engages, said second lever position changing means has second cam means with which said second lever means engages, and said first and second cam means are mounted on a fourth shaft, said apparatus further including means for rotatively driving said fourth shaft by an angle corresponding to a selected magnification.

15. An apparatus according to claim 10, 11, 12 or 13, wherein said first and second clutch means include electromagnetic clutchs, respectively.

16. An apparatus according to claim 2, 3 or 4, wherein said first lever position changing means has first cam means with which said first lever means engages, said second lever position changing means has second cam means with which said second lever means engages, said apparatus further including means for driving said first and second cam means correspondingly to a selected magnification.

17. An apparatus according to claim 11, 12 or 13, wherein said first lever position changing means has first cam means with which said first lever means engages, said second lever position changing means has second cam means with which said second lever means engages, said apparatus further including means for driving said first and second cam means correspondingly to a selected magnification.

18. A velocity changing apparatus capable of selectively putting out output forces of at least first and second different velocities, comprising:

a first shaft for receiving a drive force;

a second shaft for putting out the output force;

first and second gear means provided on said first shaft;

third and fourth gear means provided on said second shaft;

displaceable fifth gear means adapted, correspondingly to said first velocity, to mesh with both said first gear means and said third gear means to transmit the rotational force of said first shaft to said second shaft, and adapted, correspondingly to said second velocity, to be disengaged from at least one of said first gear means and said third gear means; and displaceable sixth gear means adapted, correspondingly to said second velocity, to mesh with both said second gear means and said fourth gear means to transmit the rotational force of said first shaft to said second shaft, and adapted, correspondingly to said first velocity, to be disengaged from at least one of said second gear means and said fourth gear means.

19. An apparatus according to claim 18, further including:

first movable lever means rotatably supporting said fifth gear means;

second movable lever means rotatably supporting said sixth gear means;

first lever position changing means for displacing said first movable lever means between an operative position for causing said fifth gear means to mesh with both said first and third gear means and a non-operative position for causing said fifth means to be disengaged from at least one of said first and third gear means; and second lever position changing means for displacing said second movable lever means between an operative position for causing said sixth gear means to mesh with both said second and fourth gear means and a non-operative position for causing said sixth gear means to be disengaged from at least one of said second and fourth gear means.

20. An apparatus according to claim 19, wherein said fifth gear means is also in mesh engagement with said third gear means when said first movable lever means is in said non-operative position, and said sixth gear means is also in mesh engagement with said fourth gear means when said second movable lever means is in said non-operative position.

21. An apparatus according to claim 19, wherein said fifth gear means is also in mesh engagement with said first gear means when said first movable lever means is in said non-operative position, and said sixth gear means is also in mesh engagement with said second gear means when said second movable lever means is in said non-operative position.

22. An apparatus according to claim 19, 20 or 21, wherein said first lever position changing means has first cam means with which said first lever means engages, said second lever position changing means has second cam means with which said second lever means engages, and apparatus further including means for driving said first and second cam means correspondingly to a selected velocity.

23. An apparatus according to claim 19, 20 or 21, wherein said first lever position changing means has first cam means with which said first lever means engages, said second lever position changing means has second cam means with which said second lever means engages, and said first and second cam means are mounted on a third shaft, said apparatus further including means for rotatively driving said third shaft by an angle corresponding to a selected velocity.

* * * * *